US011351748B2

(12) United States Patent
Mora Flores

(10) Patent No.: US 11,351,748 B2
(45) Date of Patent: Jun. 7, 2022

(54) FLEXIBLE PACKAGE-FORMING MACHINE FOR HORIZONTAL PACKAGING AND METHOD OF MANUFACTURING FLEXIBLE PACKAGES

(71) Applicant: MESPACK, SL, Santa Perpetua de Mogoda (ES)

(72) Inventor: Francisco Mora Flores, Mollet del Valles (ES)

( * ) Notice: Subject to any disclaimer, the term of this patent is extended or adjusted under 35 U.S.C. 154(b) by 326 days.

(21) Appl. No.: 16/606,832

(22) PCT Filed: Feb. 22, 2018

(86) PCT No.: PCT/EP2018/054371
§ 371 (c)(1),
(2) Date: Oct. 21, 2019

(87) PCT Pub. No.: WO2018/192702
PCT Pub. Date: Oct. 25, 2018

(65) Prior Publication Data

US 2020/0047446 A1 Feb. 13, 2020

(30) Foreign Application Priority Data

Apr. 21, 2017 (EP) ..... 17382213

(51) Int. Cl.
*B31B 70/00* (2017.01)
*B31B 70/10* (2017.01)
(Continued)

(52) U.S. Cl.
CPC ..... *B31B 70/006* (2017.08); *B31B 70/10* (2017.08); *B31B 70/142* (2017.08);
(Continued)

(58) Field of Classification Search
CPC ..... B31B 2155/0014; B31B 70/262; B31B 70/006; B31B 70/10; B31B 70/142; B65H 2301/4491; B65H 20/34; B65H 23/00
(Continued)

(56) References Cited

U.S. PATENT DOCUMENTS 3,553,934 A * 1/1971 Johnson ..... B65C 11/021 493/239
5,800,325 A * 9/1998 Wilkes ..... B31B 70/00 493/196

(Continued)

*Primary Examiner* — Robert F Long
*Assistant Examiner* — Xavier A Madison
(74) *Attorney, Agent, or Firm* — Eugenio J. Torres-Oyola; Victor M. Rodriguez-Reyes; Rafael Rodriguez-Muriel

(57) ABSTRACT

The present invention relates to a flexible package-forming machine for horizontal packaging and method of manufacturing flexible packages. The proposed forming machine consists of an unwinding unit (11), a perforating unit (12), a folding unit (14), a welding unit (16), and a cutting unit (17), wherein a compensating unit (13) is further included intercalated between the perforating unit (12) and the folding unit (14), linking a section with intermittent forward movement (S1) of the flexible band (1) where the flexible band moves in an intermittent manner and including the perforating unit, and a section with continuous forward movement (S2) where the flexible band moves in a continuous manner and including the folding unit, flexible band being accumulated in said compensating unit during the forward movement of the section with intermittent forward movement (S1) and the accumulation being reduced during breaks in the forward movement of the section with intermittent forward movement.

11 Claims, 2 Drawing Sheets

(51) Int. Cl.

| | |
|---|---|
| ***B31B 70/14*** | (2017.01) |
| ***B65H 20/34*** | (2006.01) |
| ***B65H 23/00*** | (2006.01) |
| ***B31B 70/26*** | (2017.01) |
| *B31B 70/64* | (2017.01) |
| *B31B 155/00* | (2017.01) |

(52) U.S. Cl.
CPC ..... *B31B 70/262* (2017.08); *B65H 20/34* (2013.01); *B65H 23/00* (2013.01); *B31B 70/642* (2017.08); *B31B 2155/0014* (2017.08); *B65H 2301/4491* (2013.01)

(58) Field of Classification Search
USPC ..... 493/227
See application file for complete search history.

(56) References Cited

U.S. PATENT DOCUMENTS

| | | | | | |
|---|---|---|---|---|---|
| 5,830,118 | A * | 11/1998 | Nicholson | B31B 70/00 | 493/196 |
| 6,195,967 | B1 * | 3/2001 | Todd | B65B 1/02 | 53/562 |
| 6,272,815 | B1 * | 8/2001 | Todd | B29C 66/0342 | 53/64 |
| 2001/0009090 | A1 * | 7/2001 | Todd | B29C 66/43121 | 53/64 |
| 2013/0112728 | A1 * | 5/2013 | Clement | B65H 26/025 | 226/1 |
| 2016/0016748 | A1 * | 1/2016 | Oku | B65H 23/18 | 226/8 |
| 2017/0157882 | A1 * | 6/2017 | Lin | B31B 70/00 | |
| 2019/0168986 | A1 * | 6/2019 | Civolani | B31B 70/262 | |

* cited by examiner

FLEXIBLE PACKAGE-FORMING MACHINE FOR HORIZONTAL PACKAGING AND METHOD OF MANUFACTURING FLEXIBLE PACKAGES

FIELD OF THE ART

The present invention relates to a flexible package-forming machine for horizontal packaging by folding and welding a flexible band and method of manufacturing flexible packages, of the type that allows obtaining, from a flexible band, flexible packages that can be filled or are filled through a fill opening located in the top half of the formed package. Said flexible band is subjected to a folding process in which it is fold in half, for example, its two halves being arranged opposite one another and making at least transverse welding lines which, together with the folding line, create a leak-tight pouch-like container open on its top half for subsequent filling.

STATE OF THE ART

Flexible package-forming machines for horizontal packaging are known. Said machines typically allow, by means of a folding unit, folding a flexible band at at least one folding line parallel to the forward movement direction of the flexible band through the forming machine, at least two halves of said flexible hand being arranged opposite one another. Then, the forming machine proceeds to weld, by means of a welding unit, the opposite faces of the flexible band to one another at least in the welding lines transverse to the forward movement direction, forming a string of laterally joined packages which can be separated by a cutting unit.

The folding unit, for example a forming triangle provided with two converging edges around which the flexible band runs in the forward movement direction, the band being folded, requires the flexible band to move in the forward movement direction at a constant speed in order to offer a constant resistance and therefore a uniform folding.

Some flexible packages require perforating the flexible band before folding, particularly if said perforations coincide with folding areas or with welding areas. In those cases, the perforations are made by a perforating unit located before the folding unit in the forward movement direction of the flexible band. Since the flexible band moves at a constant speed through the folding unit, the known forming machines have a perforating unit capable of perforating the flexible band while it moves at a constant speed in the forward movement direction.

Some known examples use a high-speed perforating unit which allows performing high-speed perforation without stopping the flexible band, perforating units of this type being very costly and hard to calibrate.

Another known solution is to arrange a perforating unit provided with a die-cutting cylinder which rotates in coordination with the forward movement of the flexible band, but this solution requires replacing said cylinder and even modifying its diameter in order to adapt it to different formats of flexible packages to be manufactured.

It is also known to install the perforating unit on a carriage which, during a perforation step, moves parallel to the flexible band at the same speed, allowing precise perforation, and returns to the beginning of its path during a non-perforation step. However, this solution is mechanically complex and therefore, laborious.

BRIEF DESCRIPTION OF THE INVENTION

According to a first aspect, the present invention relates to a flexible package-forming machine for horizontal packaging by folding and welding a flexible band.

Machines of this type are used for obtaining, based on handling a band made of a flexible material, individual flexible packages ready to be filled and sealed.

The reference to horizontal packaging means that the flexible packages obtained form, before separation thereof by means of cutting performed by a cutting unit, a horizontal band of laterally connected flexible packages, each of them defining a closed enclosure in its bottom half and provided with a fill opening in its top half, thereby allowing individual filling of each flexible package by pouring the content through said fill opening before or after said separation by means of cutting.

The handling of the flexible band for obtaining the flexible packages basically consists of an operation of folding the parts of one and the same face of the flexible band so that they face one another, thereby defining a conduit that is open in its top half, subsequent welding of the opposite parts of the flexible band subdividing said conduit into packages that are open in their top half, and finally separating the flexible packages by means of cutting which can be performed before or after filling.

Some flexible package designs require perforations to be made in the flexible band before folding and welding. In these cases, before folding the flexible band a perforating operation must be performed by means of a perforating unit.

The proposed machine therefore comprises, in this order with respect to a forward movement direction of the flexible band:

- an unwinding unit for unwinding the flexible band in the forward movement direction;
- a perforating unit of the flexible band for perforating the flexible band in pre-established precise positions thereof;
- a folding unit of the flexible band configured for folding said flexible band along at least one folding line parallel to the forward movement direction, at least two portions arranged on opposite sides of said at least one folding line of one and the same face of the flexible band being arranged opposite one another;
- a welding unit of the folded flexible band configured for making welding lines at least in a direction transverse to the forward movement direction of the flexible band;
- a cutting unit for separating the flexible packages.

Rolls of flexible band will be fed to the unwinding unit and the rotation thereof can be operated by means of a motor. Said rolls can be printed rolls or the machine can include a printing unit, if desired, for including printed motifs on the flexible packages.

The folding unit can be of many different natures, although it will preferably consist of a forming triangle defining two converging edges around which the flexible band slides, the folding thereof being performed by way of transition between a flat shape and a folded shape. It is also contemplated for the folding unit to have a more complex geometry, provided with more edges, making a W-shaped fold, for example, along three folding lines parallel to the forward movement direction of the flexible hand, thereby obtaining flexible packages provided with a base that keeps the packages upright.

In an illustrative and non-limiting manner, the welding unit can also consist of hot clamps configured for pressing the flexible hand in pre-established precise positions long enough so that the heat of said hot clamps partially melts the material of the opposite parts of the flexible band, causing the welded attachment thereof.

The cutting unit can also be of many different natures, such as for example, it can consist of sharp, blade-like clamps which reproduce the pattern to be cut and are configured for closing on the pre-established precise positions of the folded and welded flexible band, cutting same. Obviously, the possibility of the proposed forming machine further including systems for holding and conveying the separated flexible packages, such as for example, moving clips for holding and conveying each individual flexible package, is contemplated.

The forming machine can furthermore integrate other units such as a filling unit of the flexible packages provided for depositing a precise amount of product into each flexible package through a fill opening provided in its top half, or a scaling unit configured for sealing said fill opening after filling.

Depending on the type of flexible packages to be produced it will be necessary to make perforations in the flexible band before folding and welding, making cuts or holes in areas that become hard to access after folding and welding or make the folding and welding tasks easier, for example, making cuts for tearing the flexible package with ease for consumption, making holes in areas where multiple layers of flexible band will be superimposed after folding to reduce the resulting final thickness, or making openings for subsequent placement of a dispensing nozzle, a stopper or another complement, for example.

To make said perforations, the forming machine includes a perforating unit located before the folding unit in the forward movement direction of the flexible band, which can be a die-cutting unit, for example.

The movement of the flexible band through the folding unit must be ideally constant, such that the friction is also always constant and the folding obtained homogeneous.

However, a perforating unit provided for operating on a flexible band in constant movement is complex and expensive, so the present invention proposes including a movement compensating unit for compensating the movement of the flexible band intercalated between the perforating unit and the folding unit, allowing the perforating unit to operate on a flexible band with intermittent movement.

It will be understood that a compensating unit is a unit which allows storing and releasing small amounts of flexible band, the mean inlet speed and the mean outlet speed of the flexible band in the compensating unit being the same, but one being at a constant speed and the other being at a variable speed with intermittent movement.

Therefore, said compensating unit will link a section with intermittent forward movement of the flexible band where the speed of the flexible band will be variable and include breaks, and a section with continuous forward movement of the flexible band where the speed of the flexible band will be homogenous and constant.

The section with intermittent forward movement will include the perforating unit and the section with continuous forward movement will include the folding unit.

Said compensating unit is provided with at least:

one inlet roller in contact with the flexible band, said inlet roller having an axis of rotation perpendicular to the forward movement direction and fixed with respect to the forming machine, one outlet roller in contact with the flexible band, said outlet roller having an axis of rotation perpendicular to the forward movement direction and fixed with respect to the forming machine;

at least one accumulator roller in contact with the flexible band, said accumulator roller being arranged between the inlet roller and the outlet roller in the forward movement direction, and provided with an axis of rotation perpendicular to the forward movement direction and movable with respect to the axes of rotation of the inlet roller and the outlet roller being kept perpendicular to the forward movement direction of the flexible band;

said accumulator roller being provided with and/or connected to a tautening device provided for moving the accumulator roller away from the inlet roller and/or outlet roller, keeping the flexible band taut.

In other words, the flexible band will drive the accumulating unit going through, in this order, an inlet roller that does not move from its position, at least one accumulator roller the position of which can be moved with respect to the inlet roller and/or outlet roller, and an outlet roller that does not move from its position.

As a result of this configuration, when the instantaneous speed of the flexible band in the section with intermittent forward movement is greater than the instantaneous speed in the section with continuous forward movement, an amount of flexible hand will be accumulated inside the compensating unit by means of the at least one compensating roller moving away with respect to the inlet roller and/or outlet roller driven by the tautening device.

When, in contrast, the instantaneous speed of the section with intermittent forward movement is less than the instantaneous speed of the section with continuous forward movement, said amount of flexible hand accumulated in the compensating unit will be taken out of storage and released towards the section with continuous forward movement.

These two operations will be cyclically repeated, the mean speed of the sections of intermittent and continuous forward movement being kept the same.

Furthermore, it is envisaged that the section with intermittent forward movement includes an intermittent drive unit configured for moving the flexible band in the forward movement direction in an intermittent manner, and that the section with continuous forward movement includes a continuous drive unit configured for moving the flexible band in the forward movement direction in a continuous manner.

The intermittent and continuous drive units can be, by way of example, rollers or pairs of opposite rollers operated by a motor or servomotor. Preferably, said drive units will be located at the end or close to the end of the corresponding sections with intermittent forward movement and continuous forward movement.

According to a proposed additional embodiment, the inlet roller, the outlet roller and the accumulator roller of the compensating unit are horizontal rollers. In such case, the tautening device of the accumulator roller can include a guiding system of the accumulator roller with a vertical component, the accumulator roller being at a lower height than the inlet roller and the outlet roller during accumulation, causing the tautening of the flexible band by gravity. In other words, the weight of the accumulator roller itself will act as part of the tautening device, urging said roller to move away from the inlet roller and/or outlet roller by gravity, keeping the flexible band taut at all times.

Additionally, it is proposed that the guiding system includes cogwheels at the ends of the accumulator roller and cogged tracks at the two opposite ends of the accumulator roller, thereby assuring that the movement of said accumulator roller will keep its axis perpendicular to the forward movement direction of the flexible band at all times.

Alternatively, it is proposed that the tautening device includes springs provided for moving the at least one accumulator roller away from the inlet roller and the outlet roller.

According to other embodiments, the accumulator roller may actually be a plurality of accumulator rollers, for example two or more, and the accumulating unit may further include, optionally, other intermediate fixed rollers intercalated between the plurality of accumulator rollers, the amount of flexible band stored in said compensating unit may thus be increased without increasing the size of the compensating unit too much.

Preferably, the perforating unit will be a die-cutting unit, and in a preferred and non-limiting manner, this will be arranged opposite a horizontal segment of the flexible band.

According to a preferred embodiment, at least the perforating unit, the compensating unit and the folding unit are supported on a common frame defining a compact forming module.

It is furthermore proposed that the compensating unit and the folding unit are arranged above the horizontal segment of the flexible band opposite the die-cutting unit, thereby achieving a compact construction.

According to another embodiment that is provided, there is intercalated between the folding unit and the welding unit an additional movement compensating unit for compensating the movement of the flexible band, separating a section with continuous forward movement from an additional section with intermittent forward movement of the flexible band, said additional compensating unit being provided with at least:

- one inlet roller in contact with the folded flexible band with an axis of rotation perpendicular to the forward movement direction of the folded flexible band,
- one outlet roller in contact with the folded flexible band with an axis of rotation perpendicular to the forward movement direction of the folded flexible band;
- at least one accumulator roller in contact with the folded flexible band between the inlet
- roller and the outlet roller in the forward movement direction, and with an axis of
- rotation perpendicular to the forward movement direction of the folded flexible band;

the at least one accumulator roller being movable with respect to the inlet roller and the outlet roller, keeping the axis of rotation thereof perpendicular to the forward movement direction of the flexible band, and said actuator roller being provided with and/or connected to a tautening device provided for moving the accumulator roller away from the inlet roller and outlet roller, keeping the flexible band taut; and wherein the additional section with intermittent forward movement includes an additional intermittent drive unit.

According to this additional embodiment, the forming machine will have a section with intermittent forward movement where the perforating unit is included, a compensating unit, a section with continuous forward movement where the folding unit is included, an additional compensating unit, and an additional section with intermittent forward movement where the welding unit is included. This construction allows performing optimum folding on a flexible band moved continuously while at the same time allows performing other operations on the flexible band moved intermittently, utilizing the stops to perform said operations in an optimum manner.

Additionally, it is contemplated that the inlet roller of the compensating unit is also the intermittent drive unit of the section with intermittent forward movement of the flexible band.

According to a second aspect, the present invention relates to a method for forming flexible packages for horizontal packaging by means of folding and welding a flexible band comprising the steps of:

- feeding a flexible band in the forward movement direction to the flexible package forming machine by means of an unwinding unit for unwinding the flexible band;
- driving said flexible band in the forward movement direction;
- perforating said flexible band in pre-established precise positions by means of a perforating unit of the flexible band, obtaining a perforated flexible band;
- folding, by means of a folding unit, said flexible hand along at least one folding line parallel to the forward movement direction, at least two portions arranged on opposite sides of said at least one folding line of one and the same face of the flexible band being arranged opposite one another, obtaining a folded flexible band; and at least
- welding, by means of a welding unit arranged after the folding unit in the forward movement direction, the folded flexible band along at least welding lines transverse to the forward movement direction of the flexible band;
- cutting the folded and welded flexible band for obtaining individual flexible packages;

It is proposed that the method of the present invention further includes the following steps:

- driving with an intermittent movement said flexible band in the forward movement direction through a section with intermittent forward movement by means of an intermittent drive unit;
- feeding in the forward movement direction and in an intermittent manner a compensating unit with the perforated flexible band obtained from said perforating unit, cyclic accumulation of the perforated flexible band taking place in said compensating unit during the movement of the flexible band in the section with intermittent forward movement;
- driving with a continuous movement said perforated flexible band in the forward movement direction through a section with continuous forward movement after the compensating unit in the forward movement direction by means of a continuous drive unit, cyclic deaccumulation (reduced accumulation) of the perforated flexible band taking place in said compensating unit during breaks in the intermittent movement of the flexible band in the section with intermittent forward movement;

wherein the steps of feeding the forming machine and perforating the flexible band are performed on the section with intermittent forward movement of the flexible band; and wherein the step of folding the flexible band is performed on the section with continuous forward movement of the flexible band.

The description relating to the units making up the forming machine described above is also applicable to the units carrying out the proposed method, since said method is implemented by means of the forming machine described above.

The proposed method also includes additional embodiments, such as for example, performing the followings after folding the flexible band produced by the folding unit:

feeding in the forward movement direction and in a continuous manner the folded flexible band obtained from said folding unit to an additional compensating unit;

driving with an intermittent movement said folded flexible band in the forward movement direction through an additional section with intermittent forward movement after the additional compensating unit in the forward movement direction by means of an additional intermittent drive unit, cyclic accumulation of the folded flexible band taking place in said compensating unit during breaks of the intermittent movement of the flexible band in the additional section with intermittent forward movement, and cyclic deaccumulation of the folded flexible band taking place in said additional compensating unit during the movement of the flexible band in the section with intermittent forward movement.

Additionally, it is considered that the step of welding the folded flexible band by means of a welding unit is performed on the additional section with intermittent forward movement of the flexible band during breaks in the intermittent movement of the flexible band.

It will be understood that references to geometric position, such as for example, parallel, perpendicular, tangent, etc. allow deviations of up to ±5° with respect to the theoretical position defined by said nomenclature.

Other features of the invention will be seen in the following, detailed description of an embodiment.

BRIEF DESCRIPTION OF THE DRAWINGS

The foregoing and other advantages and features will be more clearly understood based on the following detailed description of an embodiment in reference to the attached drawings which must be interpreted in an illustrative and non-limiting manner, in which.

DETAILED DESCRIPTION OF AN EMBODIMENT

The attached drawings show illustrative but non-limiting embodiments of the present invention.

Figure 1:
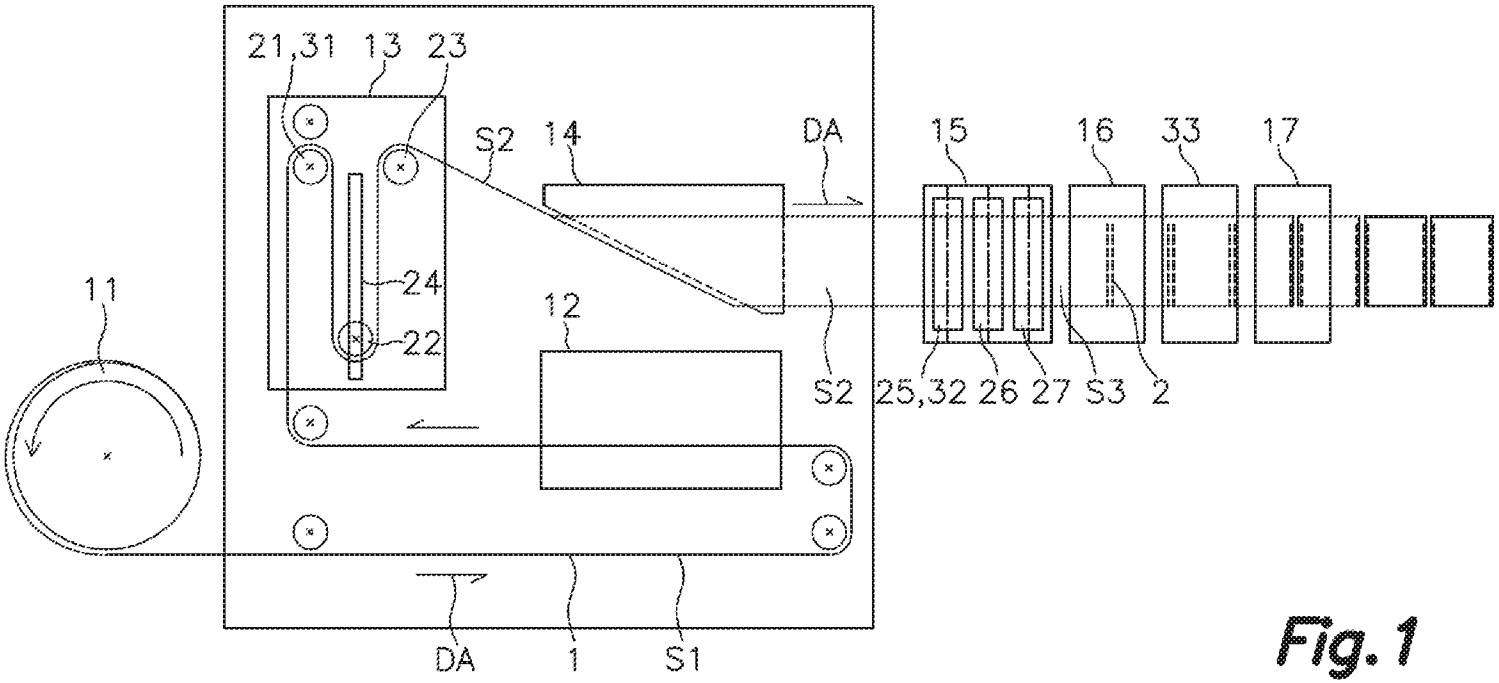
FIG. 1 shows a schematic side view of the proposed forming machine according to a preferred embodiment including a compensating unit located between the perforating unit and the folding unit, and further including an additional compensating unit between the folding unit and the welding unit.

FIG. 1 schematically shows an embodiment of the proposed forming machine including the following elements in the following order:

an unwinding unit 11 feeding a flexible band 1 to the forming machine. Said unwinding unit will consist of a reel of flexible band supported on a shaft which will allow the rotation thereof. Said flexible band will preferably be made of a plastic material and can be printed on one or both faces, or can be passed through a printing machine before being fed to the forming machine.

The flexible band moves through the forming machine in a forward movement direction DA going through, successively, a perforating unit 12, an intermittent drive unit 31, a compensating unit 13, a folding unit 14, a continuous drive unit 32, an additional compensating unit 15, a welding unit 16, an additional intermittent drive unit 33, and finally a cutting unit 17.

The segment of flexible band 1 comprised between the unwinding unit 11 and the intermittent drive unit 31 will form a section with intermittent forward movement S1 in which the flexible band 1 will move intermittently driven by said intermittent drive unit 31, taking breaks, said breaks allowing easy and precise actuation of the perforating unit 12 to make the relevant perforations on the flexible band 1.

The segment of flexible band 1 comprised between the compensating unit 13 and the continuous drive unit 32 will form a section with continuous forward movement S2 in which the flexible band 1 will move continuously driven by said continuous drive unit 32, allowing a constant and homogeneous folding of the flexible band 1 by means of the folding unit 14.

The segment of flexible band 1 after the additional compensating unit 15 will form an additional section with intermittent forward movement S3 in which the flexible band 1 will move intermittently driven by said intermittent drive unit 31, taking breaks, said breaks allowing easy and precise actuation of the welding unit 16 and the cutting unit 17.

Figure 2:
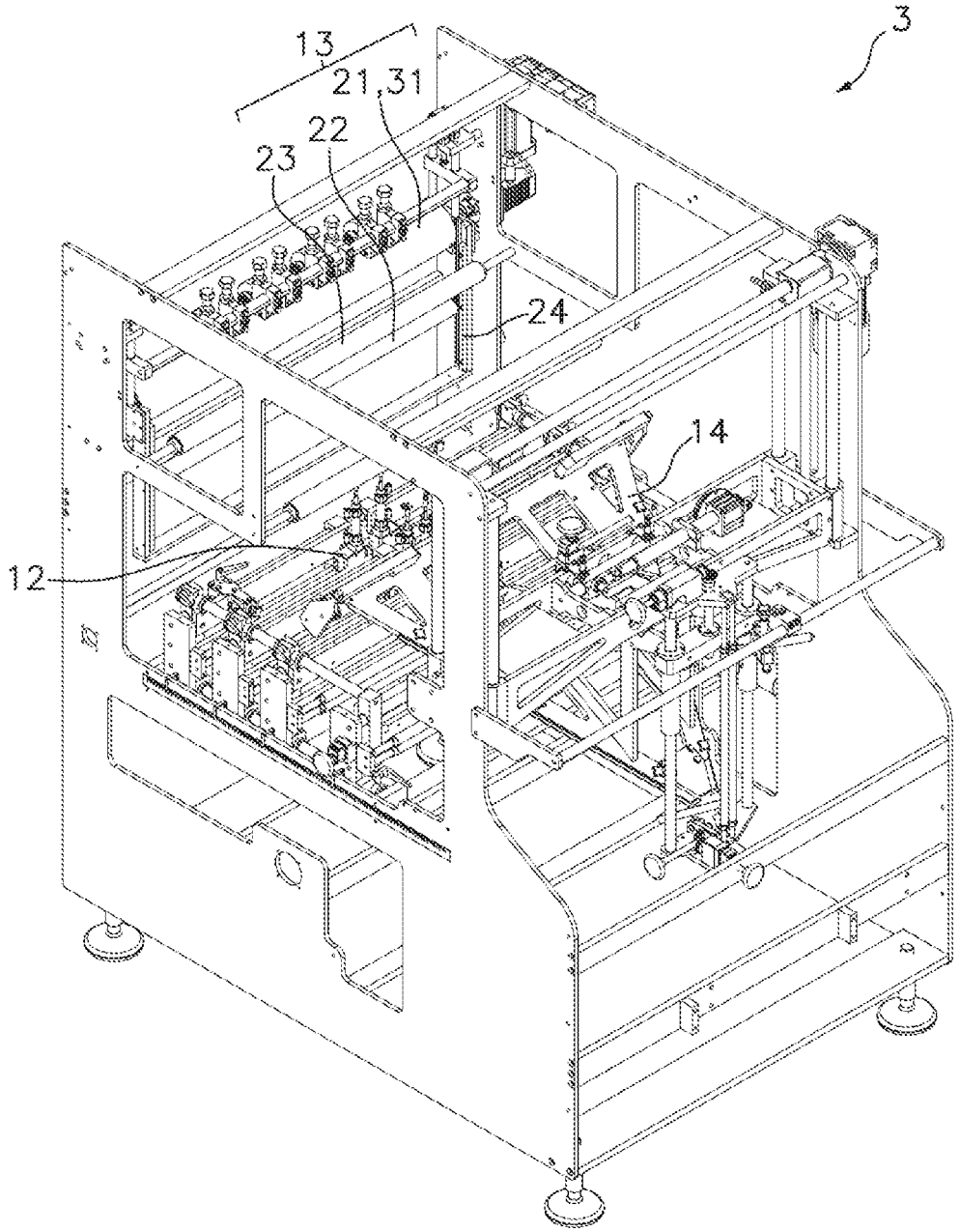
FIG. 2 shows a perspective view of a compact forming module integrating, in one and the same frame and in superposed levels, a perforating unit, a compensating unit and a folding unit.

According to the present embodiment, the perforating unit 12 is moved above a horizontal segment of the flexible band 1, and consists of a die-cutting unit, thereby allowing die-cutting the flexible band from above, eliminating the die-cut residues below said flexible band 1. It is furthermore proposed that the die-cutting unit consist of multiple dies supported on bridges perpendicular to the forward movement direction DA, said bridges being movable in the forward movement direction DA for a correct regulation and calibration of the perforating unit 12, and each die being movable along the corresponding supporting bridge, which also allows regulating the position thereof transverse to the flexible band 1. These two options of movement allow correctly adapting and positioning each die during a step of calibrating the forming machine. This embodiment is shown in FIG. 2.

The intermittent drive unit consists of a cylinder operated by means of a motor or a servomotor configured for causing the rotation of the cylinder in an intermittent manner. At least one pressure cylinder has been provided opposite said cylinder and the flexible band which is pressed against the mentioned operated cylinder and driven by the rotation of the cylinder in an intermittent manner is made to pass between both.

The compensating unit 13 consists of an inlet roller 21, which in this case is also the mentioned operated cylinder of the intermittent drive unit 31, an outlet roller 23, and between both an accumulator roller 22 located at a lower height than the other two rollers. The three rollers are parallel to one another and perpendicular to the forward movement direction DA of the flexible band 1.

The weight of said accumulator roller 22 keeps the flexible band 1 taut, and a guiding system 24 allows the vertical movement of the accumulator roller 22, making the distance thereof with respect to the inlet roller 21 and the outlet roller 22 smaller or larger depending on the amount of flexible band fed to and extracted from said compensating unit 13.

After the compensating unit, the flexible band 1 goes through the folding unit which in this example consists of a forming triangle provided with two converging edges around which the flexible hand runs in the forward movement direction, the band being folded, obtaining as a result a flexible band 1 folded along a longitudinal folding line parallel to the side edges of the flexible band 1 and parallel to the forward movement direction DA, said folding line preferably being in the center of the flexible band 1. The folded flexible band will therefore consist of two halves arranged opposite one another and joined at their lower end by the folding line and arranged opposite one another but not joined at their upper end where the two side edges of the flexible band will coincide.

According to a preferred embodiment, the folding unit makes at least three folding lines parallel to one another conferring a W-shaped section to the folded flexible band 1. This allows obtaining flexible packages capable of staying upright.

The continuous drive unit 32 and the additional compensating unit 15 will be of a nature similar to that described in relation to the intermittent drive unit 31 and to the compensating unit 13, with the exception that they are located with their axes in vertical, the continuous drive unit being configured for driving the flexible band 1 at a constant speed. Furthermore, gravity in the additional compensating unit 15 will be replaced with an elastic force supplied, for example, by means of springs or pneumatic pistons.

The welding unit 16 will join the two opposite halves of the flexible band 1 to one another along welding lines 2, at least one of them being transverse to the forward movement direction DA, thereby forming bags or pouches in the folded and welded flexible band. The weld can be produced by pressing hot clamps on opposite faces of the folded flexible band 1, faces.

The intermittent drive unit 33, which is the same as the one described above, will then drive the flexible band 1 in an intermittent manner and subsequently feed it to the cutting unit 17 which will make cuts that will separate the flexible packages, for example, by means of using blades.

FIG. 2 shows a more detailed embodiment in which the perforating unit 12, the compensating unit 13 and the folding unit 14 are supported on a shared frame forming a compact forming module in which the compensating unit 13 and the folding unit 14 move above a perforating unit 12 arranged opposite a horizontal segment of the flexible band 1.

It will be understood that the different parts making up the invention described in one embodiment can be freely combined with parts described in other different embodiments even though said combination has not been explicitly described, provided that the combination does not affect the invention.

The invention claimed is:

1. A flexible package-forming machine for horizontal packaging by folding and welding flexible band comprising, in this order with respect to a forward movement direction of the flexible band, at least:

one unwinding unit for unwinding the flexible band in the forward movement direction;

one perforating unit of the flexible band for perforating the flexible band in pre-established precise positions thereof;

one folding unit of the flexible band configured for folding said flexible band along at least one folding line parallel to the forward movement direction, at least two portions arranged on opposite sides of said at least one folding line of one and the same face of the flexible band being arranged opposite one another;

one welding unit of the folded flexible band configured for making welding lines at least in a direction transverse to the forward movement direction of the flexible band;

one cutting unit for separating portions making up flexible packages;

characterized in that:

a movement compensating unit for compensating the movement of the flexible band intercalated between the perforating unit and the folding unit, said compensating unit linking a section with intermittent forward movement of the flexible band and a section with continuous forward movement of the flexible band, said compensating unit being provided with at least:

one inlet roller in contact with the flexible band with an axis of rotation perpendicular to the forward movement direction and fixed with respect to the forming machine, one outlet roller in contact with the flexible band with an axis of rotation perpendicular to the forward movement direction and fixed with respect to the forming machine;

at least one accumulator roller in contact with the flexible band between the inlet roller and the outlet roller in the forward movement direction, and with an axis of rotation perpendicular to the forward movement direction and movable with respect to the axes of rotation of the inlet roller and the outlet roller being kept perpendicular to the forward movement direction of the flexible band;

said accumulator roller being provided with and/or connected to a tautening device provided for moving the accumulator roller away from the inlet roller and/or outlet roller, keeping the flexible band taut; the tautening device including:

springs provided for moving the at least one accumulator roller away from the inlet roller and/or outlet roller, or a guiding system of the accumulator roller with a vertical component, the inlet roller, the outlet roller and the accumulator roller being horizontal rollers and the accumulator roller being at a lower height than the inlet roller and the outlet roller (23) during accumulation, causing the tautening of the flexible band by gravity; and the section with intermittent forward movement includes an intermittent drive unit configured for moving the flexible band in the forward movement direction in an intermittent manner, and wherein the section with continuous forward movement includes a continuous drive unit configured for moving the flexible band in the forward movement direction in a continuous manner.

2. The machine according to claim 1, wherein the guiding system of the accumulator roller includes cogwheels at the ends of the accumulator roller and cogged tracks.

3. The machine according to claim 1, wherein the perforating unit is a die-cutting unit.

4. The machine according to claim 3, wherein the die-cutting unit is arranged opposite a horizontal segment of the flexible band.

5. The machine according to claim 4, wherein at least the perforating unit, the compensating unit and the folding unit are supported on a common frame defining a compact forming module, and wherein the compensating unit and the folding unit are arranged above the horizontal segment of the flexible band opposite the die-cutting unit.

6. The machine according to claim 1, wherein at least the perforating unit, the compensating unit and the folding unit are supported on a common frame defining a compact forming module.

7. The machine according to claim 1, wherein there is intercalated between the folding unit and the welding unit an additional movement compensating unit for compensating the movement of the flexible band, separating the section with continuous forward movement from an additional section with intermittent forward movement of the flexible band, said additional compensating unit being provided with at least:

one inlet roller in contact with the folded flexible band with an axis of rotation perpendicular to the forward movement direction, one outlet roller in contact with the folded flexible band with an axis of rotation perpendicular to the forward movement direction;

at least one accumulator roller in contact with the folded flexible band between the inlet roller and outlet roller in the forward movement direction, and with an axis of rotation perpendicular to the forward movement direction;

the at least one accumulator roller being movable with respect to the inlet roller and outlet roller, keeping the axis of rotation thereof perpendicular to the forward movement direction of the flexible band, and said accumulator roller being provided with and/or connected to a tautening device provided for moving the accumulator roller away from the inlet roller and/or outlet roller, keeping the flexible band taut; and wherein the additional section with intermittent forward movement includes an additional intermittent drive unit.

8. The machine according to claim 1, wherein the inlet roller of the compensating unit is also the intermittent drive unit of the section with intermittent forward movement of the flexible band.

9. A method for forming flexible packages for horizontal packaging by means of folding and welding a flexible band comprising the steps of:

feeding a flexible band in the forward movement direction to the flexible package-forming machine by means of an unwinding unit for unwinding the flexible band;

driving said flexible band in the forward movement direction;

perforating said flexible band in pre-established precise positions by means of a perforating unit of the flexible band, obtaining a perforated flexible band;

folding, by means of a folding unit, said flexible band along at least one folding line parallel to the forward movement direction, at least two portions arranged on opposite sides of said at least one folding line of one and the same face of the flexible band being arranged opposite one another, obtaining a folded flexible band;

welding, by means of a welding unit arranged after the folding unit in the forward movement direction, the folded flexible band along at least welding lines transverse to the forward movement direction of the flexible band;

cutting the folded and welded flexible band for obtaining individual flexible packages;

characterized in that the method also includes:

driving with an intermittent movement said flexible band in the forward movement direction through a section with intermittent forward movement by means of an intermittent drive unit;

feeding in the forward movement direction and in an intermittent manner the perforated flexible band obtained from said perforating unit to a compensating unit, cyclic accumulation of the perforated flexible band taking place in said compensating unit during the movement of the flexible band in the section with intermittent forward movement;

driving with a continuous movement said perforated flexible band in the forward movement direction through a section with continuous forward movement after the compensating unit in the forward movement direction by means of a continuous drive unit, cyclic deaccumulation of the perforated flexible band taking place in said compensating unit during breaks in the intermittent movement of the flexible band in the section with intermittent forward movement;

wherein the steps of feeding the forming machine and perforating the flexible band are performed on the section with intermittent forward movement of the flexible band; and wherein the step of folding the flexible band is performed on the section with continuous forward movement of the flexible band.

10. The method according to claim 9, wherein after folding the flexible band produced by the folding unit, the followings is performed feeding in the forward movement direction and in a continuous manner the folded flexible band obtained from said folding unit to an additional compensating unit;

driving with an intermittent movement said folded flexible band in the forward movement direction through an additional section with intermittent forward movement after the additional compensating unit in the forward movement direction by means of an additional intermittent drive unit, cyclic accumulation of the folded flexible band taking place in said additional compensating unit during breaks in the intermittent movement of the flexible band in the section with forward movement, and cyclic deaccumulation of the folded flexible band taking place in said additional compensating unit during the movement of the flexible band in the additional section with intermittent forward movement.

11. The method according to claim 10, wherein the step of welding the folded flexible band by means of a welding unit are performed on the additional section with intermittent forward movement of the flexible band during breaks in the intermittent movement of the flexible band.

* * * * *